United States Patent [19]

Grzeika et al.

[11] 4,342,414

[45] Aug. 3, 1982

[54] GLAZIER'S POINT DRIVER

[75] Inventors: Eugene W. Grzeika; Vincent T. Kozyrski, both of Bristol, Conn.

[73] Assignee: The Fletcher-Terry Company, Farmington, Conn.

[21] Appl. No.: 924,447

[22] Filed: Jul. 13, 1978 (Under 37 CFR 1.47)

[51] Int. Cl.[2] ..... B25C 5/00

[52] U.S. Cl. ..... 227/109; 227/120; 227/119; 227/132

[58] Field of Search ..... 227/119, 120, 132, 146, 227/109

[56] References Cited

U.S. PATENT DOCUMENTS

| | | | |
|---|---|---|---|
| 104,915 | 6/1870 | Woodworth et al. | 227/146 |
| 1,134,334 | 4/1915 | Hartley | 227/120 X |
| 1,744,700 | 1/1930 | Hubbard et al. | 227/132 |
| 3,720,364 | 3/1973 | Maestri | 227/109 |

FOREIGN PATENT DOCUMENTS

| | | | |
|---|---|---|---|
| 491784 | 1/1930 | Fed. Rep. of Germany | 227/98 |
| 590966 | 1/1934 | Fed. Rep. of Germany | 227/109 |
| 2534878 | 2/1976 | Fed. Rep. of Germany | 227/132 |
| 1376987 | 9/1964 | France | 227/132 |

*Primary Examiner*—Paul A. Bell

*Attorney, Agent, or Firm*—McCormick, Paulding & Huber

[57] ABSTRACT

The glazier holds the toe of the driver on the glass, adjacent the edge of the sash, such that a handle trigger can be operated to drive the lowermost point from the magazine into the sash by the action of a coiled compression spring. The magazine has an insert associated with it so that points of various size can be accommodated in a single point driver. Since larger points require a greater spring force, means is also provided for conveniently adjusting the compression springs displacement. The guide block and push plate assembly for driving the points into the sash are slidably supported in the frame so as to precisely engage only the lowermost point in the stack.

7 Claims, 13 Drawing Figures

GLAZIER'S POINT DRIVER

BACKGROUND OF THE INVENTION

Portable hand-operated point drivers for use by glaziers in assemblying glass in a window sash are generally trigger operated for forcibly driving the lowermost point in a stack of points provided in a magazine, and U.S. Pat. No. 1,744,700 shows the typical construction of present day point drivers. The magazine comprises an elongated receptacle for the stack of points, and a spring biased follower or bail urges the stack of points downwardly. The spring force exerted by the follower can be overcome to permit removal of the follower for reloading the magazine, but the magazine is generally so constructed as to receive only one particular size point.

A trigger mechanism is provided for operating a push plate, and includes a coiled compression spring, and a trigger return spring, and the trigger or handle comprises a bell crank which retracts, or cocks the push plate, such that when the compression spring reaches a predetermined position a predetermined spring force urges the lowermost point in the stack into the wood sash. Since points of only one predetermined size can be loaded in a particular point driver, the displacement and consequently the spring force provided by the compression spring, need readjustment only very infrequently. Once set up for driving a particular size point there is little need to alter this adjustment in prior art point drivers.

SUMMARY OF THE INVENTION

This invention relates generally to improvements over the above-described prior art point driver, and deals more particularly with improvements in the area of the magazine for such a point driver. The magazine to be described is so constructed and arranged as to accommodate stack of points of various size, and more convenient means is provided for achieving precise adjustment for the spring force exerted on the particular point to be driven, in order to provide slighly larger impact forces for the larger sized points accommodated in the improved magazine.

In its presently preferred form, the point driver of the present invention comprises a frame of generally inverted U-shape, having a toe and a heel such that the toe portion can be placed against the wood sash, and the frame used by the glazier to hold the glass in place while a point is driven into the wood sash. A guide block assembly is slidably mounted in the frame and includes a driving plate which engages the lowermost point in the magazine to drive it from the stack. A trigger mechanism is provided for cocking the block, and for releasing it so that a compression spring moves the block along a fixed path in the frame to drive the point. The trigger mechanism includes an operating lever, a return spring and pivot means defining an axis for movement of the operating lever, which pivot means includes an angularly adjustable eccentric cam shaft for varying the location of the lever pivot axis in the frame, and relative to the path of movement of the guide block. A lost motion means is provided between the operating lever and the guide block such that return movement of the operating lever can be achieved independently of the driving movement of the guide block. The magazine is adapted to accommodate the largest size point to be driven, and an insert is provided for the magazine, which insert defines a first guide surface for engaging a stack of slightly smaller points and a second guide surface for engaging a stack of points of still a third size and shape. Bail or follower means is provided to urge the stack of points downwardly so that the lowermost point occupies a position to be driven by a plate associated with the guide block. The follower is spring operated and so arranged as to be manually moved against the force of the spring from its active to an inactive position to permit reloading of the magazine.

Among the objects and advantages of the above-described invention the following deserve mention. First, to provide a point driver with an improved magazine such that points of various size can be accommodated in a single point driver structure, and with provision being made for utilization of the conventional spring loaded bail or follower arrangement for holding the stack of points in such magazine. Second, to provide a glazier's point driver wherein critical adjustments can be made to the impact force exerted by the coiled compression spring acting upon the guide block and point pusher plate, such adjustments being provided for in a convenient and repeatable manner so that the above-described advantage in terms of the accommodation of points of various size, can be achieved in a point driver wherein the impact force exerted on the point can be adjusted so as to be optimized for points of various size and weight.

DETAILED DESCRIPTION OF FIRST EMBODIMENT

Figure 1:
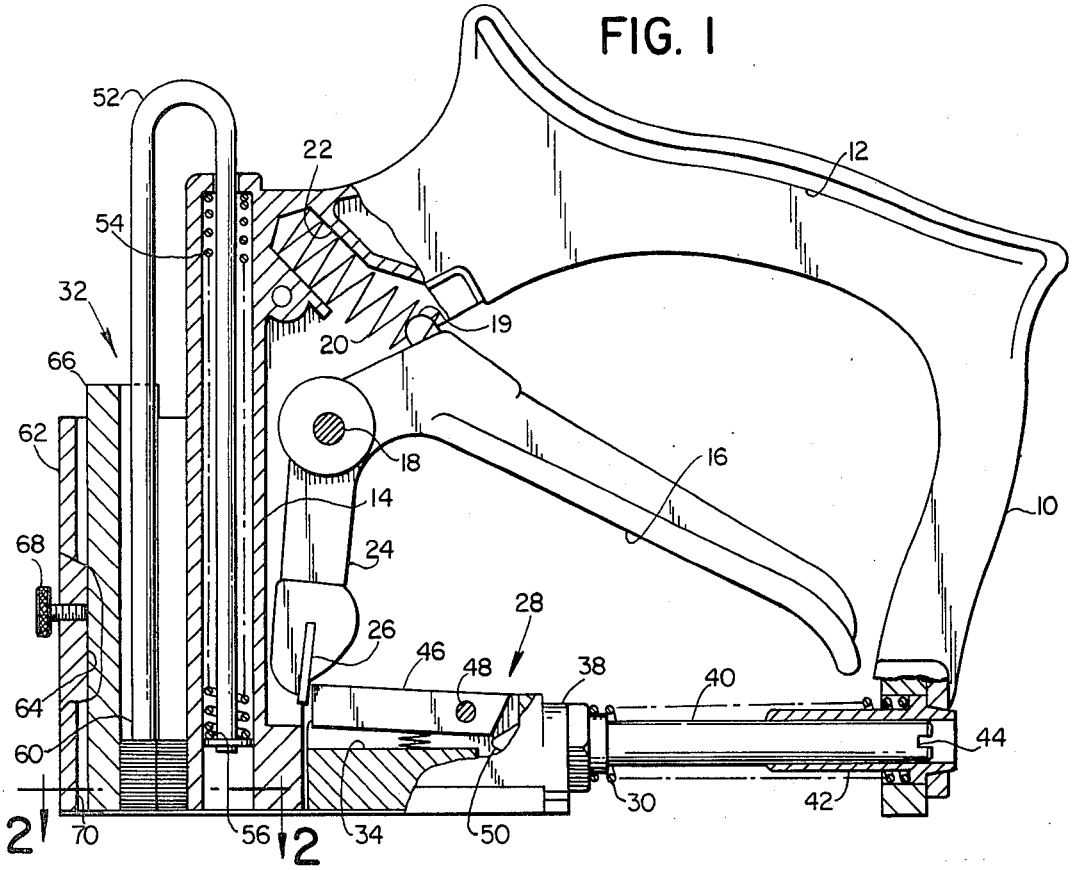
FIG. 1 is a vertical elevational view, partly in section, of a first embodiment of this invention.

Turning now to FIGS. 1 through 4 in greater detail, the point driver includes a frame 10 which has a generally inverted U-shape defining a rear leg, as shown at 10, a handle portion 12, and a front leg portion indicated generally at 14. The lower end of the front leg comprises a nose of the driver adapted to be placed against the window sash (not shown) while the user holds the device against the glass (not shown) preparatory to driving a point into the wooden sash.

An operating lever 16 is pivotally mounted in the fixed frame by pin 18, and the lever 16 is urged downwardly into the position shown by a return spring 20 acting between a land 19 spaced from the pivot 18 and a cavity 22 defined for the purpose in the frame. Still with reference to the operating lever 16, a depending crank portion 24 is provided with a blade 26 at its lower end such that squeezing the elements 12 and 16 pull upwardly on the operating lever 16, causing depending crank arm 24 to pivot counterclockwise with respect to the axis 18 retracting slide block mechanism 28 against the force of compression spring 30. This cocking motion stores energy in the spring 30 such that release of the spring 30 drives the lowermost point in a stack of points provided for this purpose in the magazine 32 at the forward end or leg of the frame.

Figure 2:
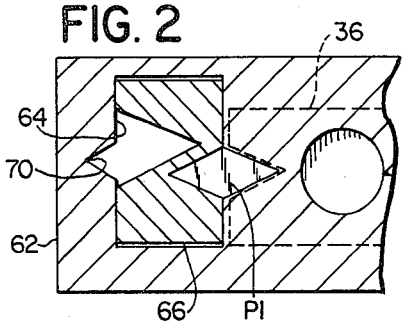
FIG. 2 is a sectional view taken generally on the line 2—2 of FIG. 1, and illustrating a magazine insert in one of two possible positions.
Figure 3:
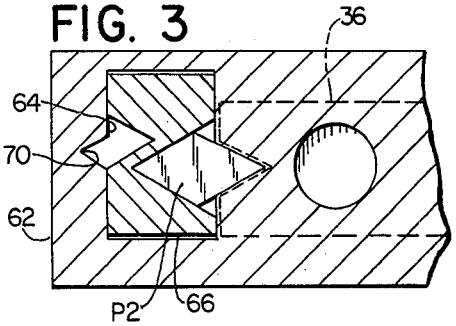
FIG. 3 is a sectional view similar to FIG. 2 but illustrating the magazine insert in an alternative position, that is in a position reversed from that of FIG. 2, so as to accommodate glazier's points of slightly larger size.
Figure 4:
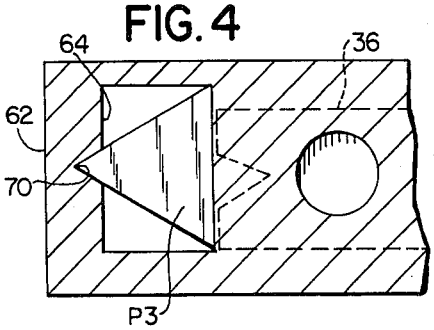
FIG. 4 is a sectional view generally similar to FIGS. 2 and 3 but illustrating the insert removed from the magazine such that the space occupied by the insert is adapted to receive a stack of points of still larger size.

The slide block mechanism 28 is generally similar to that shown in prior art U.S. Pat. No. 1,744,700 and comprises a block or plunger 34 slidabe longitudinally in the lower end of the frame. A driving plate 36 is attached to the lower surface of this block 34 as best shown in FIGS. 2–4 and serves to drive the lowermost point in the stack toward the left in FIG. 1 (forwardly).

The slide or guide block assembly 28 further includes a catch lever 46 pivotally connected at 48 to the block 34 and spring biased to the position shown in FIG. 1 such that the blade 26 of operating lever 16 can urge the slide block rearwardly during cocking movement. However, as the operating lever 16 is squeezed upwardly for cocking motion, and after the desired displacement of coiled compression spring, blade 26 will move away from the lever 46 allowing the slide block assembly 26 to move forwardly. The operating lever 16 will still be in the squeezed position (not shown) but when subsequently released lever 46 is moved counterclockwise about its pivot 48 by return movement of blade 26 to allow return movement of the operating lever 16 and its associated depending crank 24 to the position shown in FIG. 1.

Rod 40 is threadably adjusted to the desired position in the rear end of the slide block assembly 28 by means of a slot 44, and this guide rod also provides a convenient support for the compression spring 30. The rod 40 is slidably received in a bushing 42 at the lower end of the rear leg 10 of the frame and the forward end of the rod 40 is secured to the rear end of the guide block by means of the threaded connection shown at 38.

The above described structure for the point driver of FIG. 1 is of conventional configuration, and it should perhaps be noted that the U-shaped follower 52 housed in the front leg 14 of the driver frame is also of conventional configuration. A spring 54 is provided on one leg of the follower and acts between the lower end of the follower leg, indicated generally at 56, and the upper end of a receptacle provided for this purpose in the frame as shown. The U-shaped follower 52 can be grasped by the operator so as to be pulled upwardly from the position shown, to a position where the lower end of follower leg 60 is raised clear of the upper end of the magazine 32 so that the follower 52 can be swung to one side in order to permit loading of the magazine 32 to be described. As so constructed and arranged a convenient means is provided for holding the stack of loose points in the magazine, and for permitting easy reloading of the magazine according to conventional practice.

Turning next to a more complete description of the magazine structure, indicated generally at 32 in FIG. 1, the forward portion of the front leg 14 of the frame, indicated generally at 62 is of generally rectangular plan form configuration as viewed in FIGS. 2–4 and defines a generally rectangular vertically extending opening as best shown at 64 in FIGS. 2–4. A generally rectangular insert 66 is adapted to be received in this rectangular magazine opening, and it is a feature of the present invention that this insert 66 is adapted to be received in the magazine opening in more than one possible orientation. A thumbscrew 68 is adapted to lock the insert in position either to receive relative small points as indicated generally at P1 in FIG. 2 for example or to be reoriented to receive points of different size. The insert 66 can be removed and reversed so as to be champed in the position shown for it in FIG. 3 in order to receive somewhat larger points as indicated generally at P2 in FIG. 3. Finally, and as shown in FIG. 4 even larger triangular points P3 can be accommodated by removal of the insert 66 and utilization of the generally triangular notch 70 provided for this purpose in the front wall 62 of the rectangular magazine recess 64.

DETAILED DESCRIPTION OF SECOND EMBODIMENT

Figure 5:
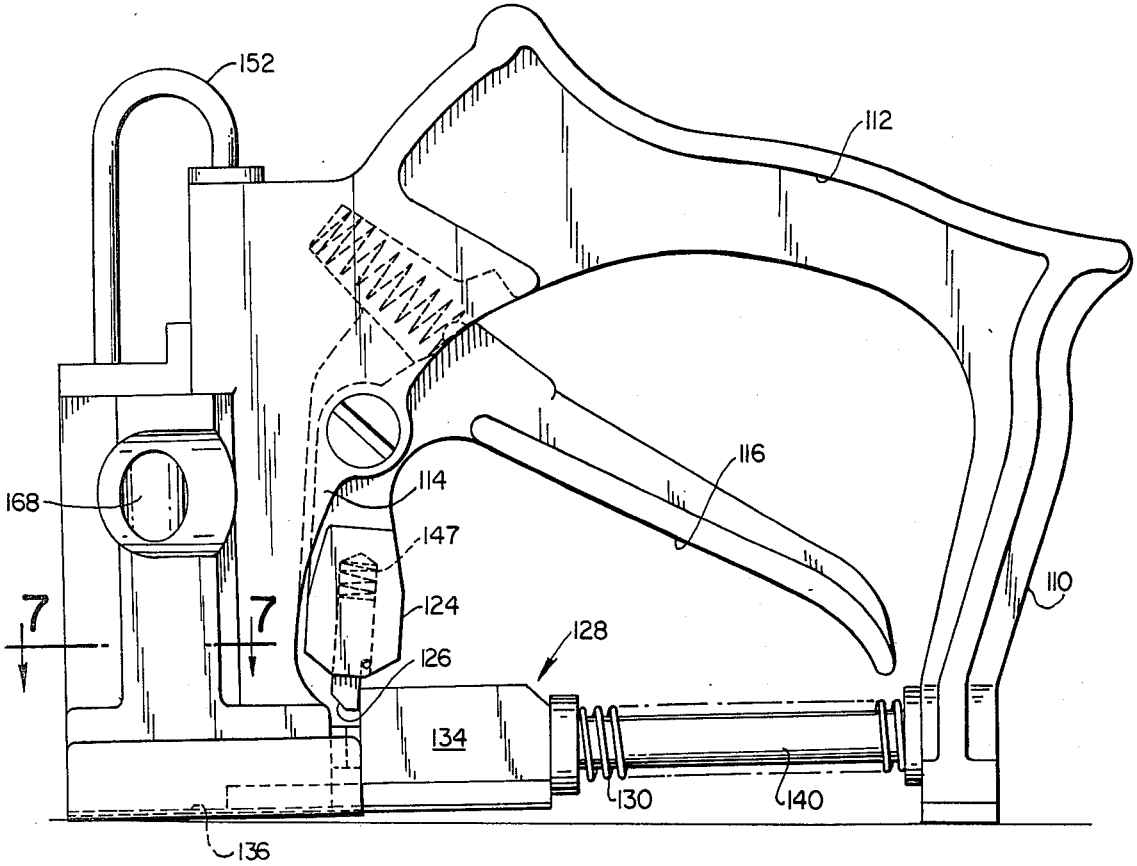
FIG. 5 is a side elevational view of a glazier's point driver constructed in accordance with a second, and presently precerred embodiment of this invention.
Figure 6:
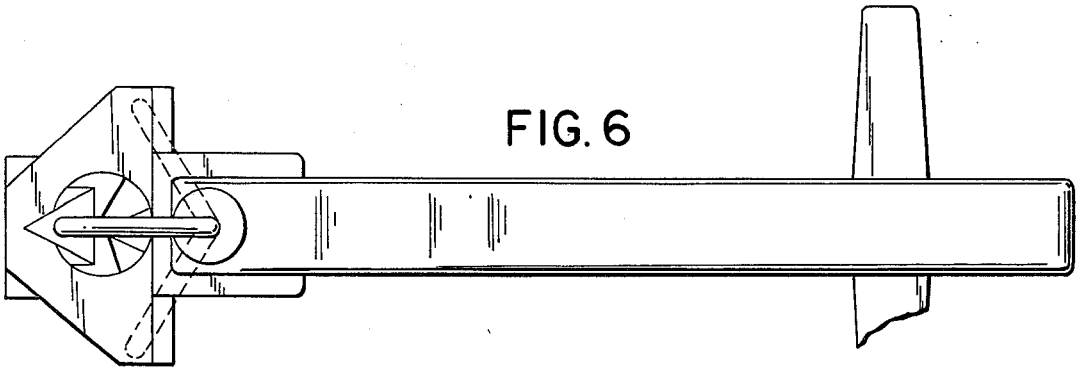
FIG. 6 is a top plan view of the point driver illustrated in FIG. 5.

Turning now to a description of the presently preferred embodiment for the point driver as illustrated in FIGS. 5 through 13 inclusively, the inverted U-shaped frame shown in FIG. 5 is generally similar to that in FIG. 1 having a rear leg 110, a handle portion 112 and a forward leg 114 which defines a magazine for the stack of points to be driven. The operating lever 116 comprises a bell crank with a lower depending arm 124 but the end portion 126 for engaging the slide block assembly 128 is not fixed in the crank arm 124 but is slidably received in the lower end of the crank arm with a spring 147 provided between the end of crank arm 124 and the upper end of the member 126 which engages the slide block 128. The forward end of the member 126 is beveled or canted slightly as shown in FIG. 5 so that like blade 26 in FIG. 1, upon achieving cocking movement of the slide block assembly 128 the pusher or drive plate 136 will move forwardly upon achieving the desired displacement of the coiled compression spring 130 as with the above-described device with reference to FIG. 1. However, upon release by the user of the operating handle 116 member 126 will engage the upper surface of the block 134 during its return movement causing retraction of the member 126 and allowing it to reassume the position shown for it in FIG. 5 preparatory to driving another point from the lower end of the magazine.

Figure 10:
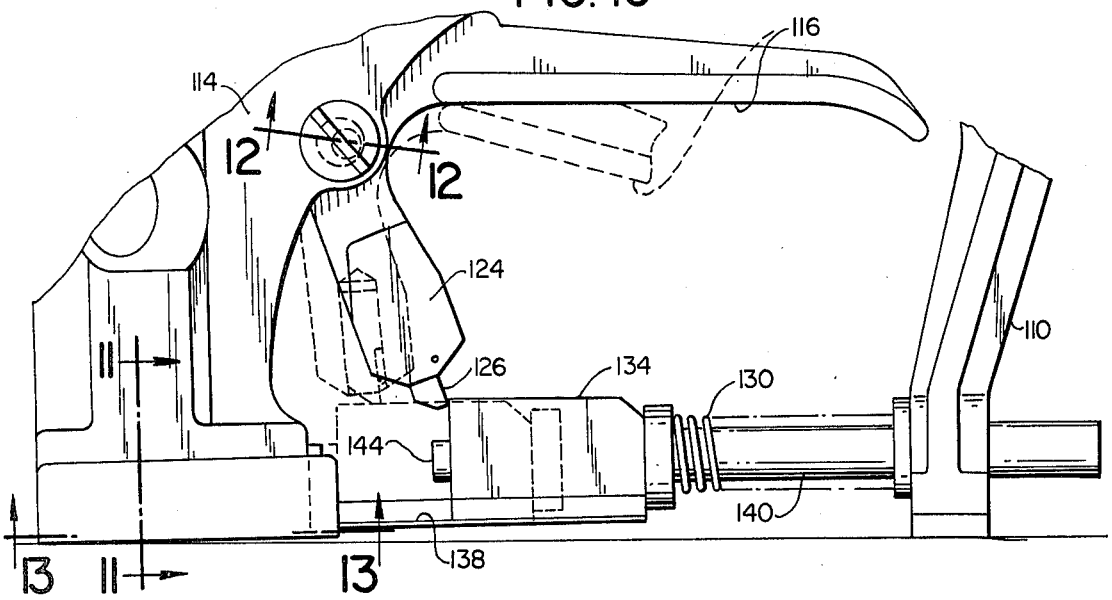
FIG. 10 is an enlarged view of the lower portion of the point driver illustrated in FIGS. 5–9, and the trigger mechanism is illustrated in two positions, the solid line position indicating an intermediate position for the operating lever and the slide block, and the broken line position illustrating a position for the trigger and slide block following driving movement of the latter, and more particularly at the moment of manual release of the handle.
Figure 12:
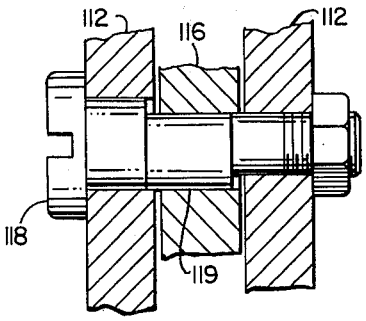
FIG. 12 is a sectional view taken generally on the line 12—12 of FIG. 10.

In order to achieve another important advantage whereby the force exerted on the point to be driven can be varied in the FIG. 5 point driver, provision is made for pivoting the operating lever 116 on an axis which can be adjusted with reference to the line of action of the slide or guide block assembly 128. As shown in FIGS. 10 and 12 the pivot axis of the operating lever 116 is defined by an eccentric screw 118 such that rotation of the screw will serve to vary the distance between the pivot axis for the lever 116 and the line of action for the guide or slide block 134. The eccentric cam shaft provides an adjustable pivot axis for the operating lever 116 in order to vary the geometry between the tip of plunger 126 and the upper forward corner of block 134 so that the point at which the drive block assembly is released for driving movement of the lowermost point in the stack can be closely controlled. This of course, provides for controlling of the force with which the point is driven as a result of the fact that varying this geometry provides for control of the stored energy in the spring 140. FIG. 12 shows this eccentric cam shaft as comprising a screw 118, with an offset shoulder 119, and the axis of the cylindrical shoulder 119 is displaced with respect to the axis of the screw 118. As a result varying the angular orientation of the screw 118, the geometry of the plunger tip can be adjusted as described above, that is with reference to the line of action of the guide or slide block assembly. The above described improvement to controlling the force exerted by the compression spring 140 represents substantial advance over the prior art in that the prior art adjustment features were all accomplished in the guide or slide block assembly which moves at a rapid rate of speed and which is subjected to large and abrupt accelerations and inertia forces as the point is driven into the wood sash. By providing the movable parts for achieving this adjustment of the driving force outside of the environment of the guide or slide block assembly more accurate control can be maintained over this force, and as a feature of the present invention this force can be varied so as to drive points of different size in the same driver.

In summary then, providing the spring 147 and plunger type member 126 in the lower end of the crank arm 124 obviates the need for the pivoted catch member 46. The need for the adjustable screw 40 associated with the rear end of said slide assembly is also obviated. The spindle 140 of the FIG. 5 version need not be adjustable because the pivot axis for the bellcrank which defines crank arm 124 and handle 116 is itself adjustable relative to the path of the slide block 134 in FIGS. 5 and 10. This adjustability of the pivot axis yields an added advantage in that the rapidly moving slide or guide block assembly 128 does not include movable pieces which must be critically adjusted for achieving optium utilization of the point driver. The FIG. 1 point driver is an improvement over the prior art, but this design is vartly improved upon as a result of the FIG. 5 point driver.

Figure 7:
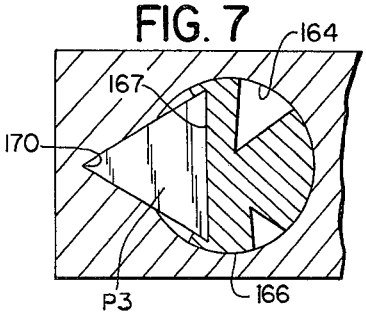
FIG. 7 is a horizontal sectional view taken generally on the line 7—7 of FIG. 5, and illustrating the insert of FIG. 6 in one of three alternative positions.
Figure 8:
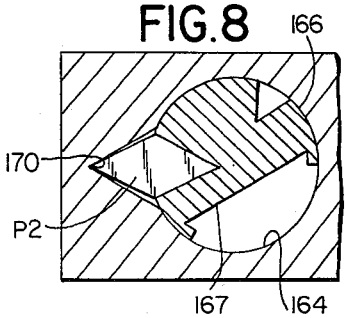
FIG. 8 is a sectional view generally similar to FIG. 7 but illustrating the insert rotated to a position approximately 120° from the FIG. 7 position such that a point of slightly smaller size can be accommodated.
Figure 9:
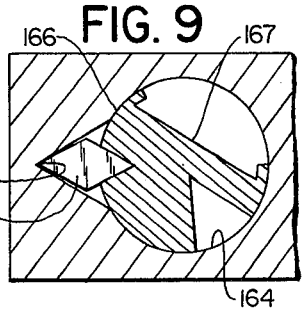
FIG. 9 is a sectional view generally similar to FIGS. 7 and 8 but illustrating the insert rotated to a still different position so as to accommodate glazier's points of smaller size than those shown in FIGS. 7 and 8.

Turning now to a more complete description of the frame for the FIG. 5 driver, a generally cylndrical magazine is provided in the forward leg 114 of the frame to receive a unique insert, best shown in FIGS. 7, 8 and 9 at 166. A cylindrical upwardly open bore 166 is provided in the lower leg 114 of the frame of the point driver and the insert 166 is shown in one position in FIG. 7, that is in position for driving generally triangular points P3 of the largest size normally used. FIG. 8 shows the insert 166 rotated approximately 120° counterclockwise in order to accommodate diamond shaped points P2 of intermediate size, and FIG. 9 shows the insert 166 rotated through a still further angle to present a relatively small guide surface to orient relatively small diamond shaped points P1. Unlike the insert 66 described above with reference to the FIG. 1 embodiment the insert 166 cooperates with a triangular notch 170 defined in the forward surface of the generally cylindrical magazine bore 164, and all three style points are adapted to be received between said triangular notch and one of three guide surfaces defined at angularly spaced locations in the cylindrical surface of the insert 166. For example, in FIG. 7, the relatively large triangular insert P3 has one apex of its triangle received in the notch 170, and had the base of the triangle received in the cut away portion 167 of insert 166 as shown to best advantage in FIGS. 8 and 9. Similar cut away portions of the insert are provided for defining guide surfaces to accommodate the inserts P1 and P2 respectively, and means may be provided for releasably retaining the insert 166 in the magazine cavity 164 in any one of these three angular orientations as depicted in FIGS. 7, 8 and 9. A ball detent subassembly may be used as suggested in broken lines in FIG. 7, for this purpose with the spring loaded ball detent barrel being provided threadably in a cavity defined for this purpose in the insert, and with three detents being defined in the cylindrical side wall of the cavity 164 in order to receive the ball, and thereby releasably retain the insert in the desired angular position.

The points are thus retained in the magazine between the insert and the side wall defined by the forward leg of the frame. These points are urged downwardly by a follower 152 much like that described above with reference to the FIG. 1 embodiment. A spring is provided to urge the follower downwardly so that one leg engages the top of the stack of inserts in the magazine and the other leg is engaged by a spring acting between the frame and its lower end for this purpose. Spring force can be manually overcome by the user as a result of grasping the U-shaped upper bail portion, of the follower 152 and pulling it upwardly. Rotating the follower to one side as suggested in FIG. 6 by the broken lines in that view serves to store the follower in an inactive position in order to reload the magazine with points of the same size or to allow rotation of the insert so as to receive points of a different size. The forward leg 114 of the frame may include clearance openings 168 on either side of the magazine defining structure so as to permit the user to use his fingers to move the cylindrical insert upwardly out of its associated cavity if this be necessary for any reason.

Figure 11:
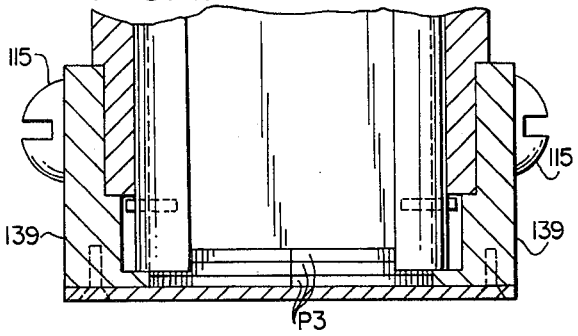
FIG. 11 is a vertical sectional view taken generally on the line 11—11 of FIG. 10.
Figure 13:
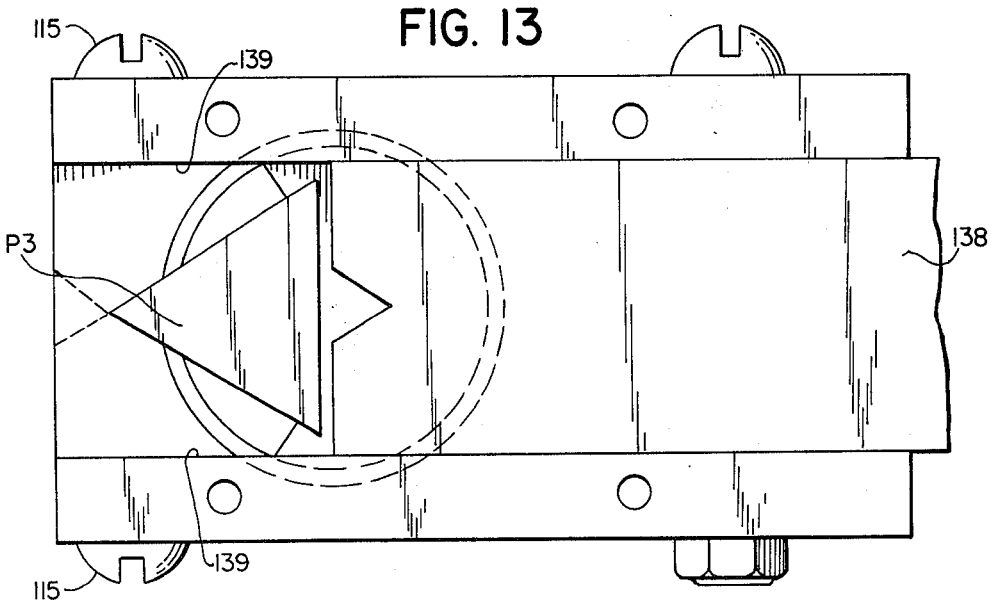
FIG. 13 is a sectional view taken generally on the line 13—13 of FIG. 10.

FIG. 11 and FIG. 13 illustrate the configuration of the driver adjacent the lower end of the forward leg 114, and more particularly in the area of the lowermost point in the stack, as shown at P3 in FIG. 13, which point will be driven by the driver plate 138. As shown in FIG. 13 the plate 138 is slidably received between fixed guide plates 139, 139 and these guide plates are secured to the lower end of the frame leg 114 by means of the screws 115, 115. The driver plate 138 is attached to the underside of slide block 134 by suitable means, such as screws (not shown), and a bumper 144 may be provided on the forward end of the block 134 to cushion the block 134 and guide block assembly at the forward limit of its travel. However, the impact of the plate 138 with the point P3 at the lower end of the stack in the magazine is such that the front apex of the triangular point will be driven into the wood sash with sufficient force to provide a good connection with the wood sash and at the same time leave a portion of the point exposed for engagement with the glass pane to hold the pane in place. The impact force will vary depending upon the size points being used, and therefor the driver described provides a significant improvement over prior art drivers in that this force can be adjusted over a wide range in a driver capable of handling points of several different size and/or shape.

We claim:

1. In a glazier's point driver having a frame defining a magazine for a stack of points and a main spring biased driving block including a plate for engaging the endmost point in the stack, and a trigger mechanism for cocking the block and releasing it for movement along a path fixed in the frame to drive the point, the improvement to said trigger mechanism comprising an operating lever, spring return means for said lever, pivot means defining an axis for movement of said operating lever and including an angularly adjustable eccentric cam for varying the location in said frame of the lever pivot axis with respect to the path of the block, and catch means for releasably latching said operating lever and driving block during cocking movement, said catch means including at least one spring biased element between said lever and said block to permit independent driving movement of the block and return movement of the operating lever preparatory to a succeeding cocking and driving motion.

2. The combination defined in claim 1 wherein said catch means comprises said spring biased element slidably received in an opening provided in said operating lever, said element having a block engaging notch, and a spring in said opening to bias said element toward said block.

3. The point driver of claim 1 wherein said magazine comprises elongated insert means for said magazine and defining a first guide surface for engaging a stack of points of one particular size and shape, said insert means defining a second guide surface for engaging a stack of points of a second and different size and shape, said insert means mounted in said frame to cooperate with said magazine when oriented in a first and a second position alternatively, said stack biasing means and said point driving plate adapted to operate as aforesaid with said insert means in both said alternative positions.

4. The point driver of claim 3 wherein said elongated insert means defines a third guide surface for engaging a stack of points of a third size and shape, said insert means mounted in said frame to cooperate with said magazine when oriented in a third position angularly spaced from said first and second alternative positions.

5. The point driver of claim 3 or 4 wherein said elongated insert means is rotatable about its longitudinal axis in said magazine, at least when no points are stacked in either of said insert positions.

6. A point driver for glaziers points comprising a frame defining a magazine for a stack of points, elongated insert means for said magazine and defining a first guide surface for engaging a stack of points of one particular size and shape, said insert means defining a second guide surface for engaging a stack of points of a second and different size and shape, said insert means mounted in said frame to cooperate with said magazine when oriented in a first and a second position alternatively, said stack biasing means and said point driving plate adapted to operate as aforesaid with said insert means in both said alternative positions, a point driving block slidably mounted in said frame and including a driving plate which engages the endmost point in the magazine to drive it from the stack, biasing means for said block, trigger mechanism for cocking the block for movement along a path fixed in said frame to drive a point, said trigger mechanism including an operating lever, spring return means for said lever, pivot means defining an axis for movement of said operating lever and including an angularly adjustable eccentric cam for varying the location in said frame of the lever pivot axis with respect to the path of said block, and catch means for releasably latching said operating lever and driving block during cocking movement, said catch means including at least one spring biased element between said lever and said block to permit independent driving movement of said block and return movement of said operating lever preparatory to a succeeding cocking and driving motion.

7. The point driver of claim 6 wherein said catch means comprises said spring biased element slidably received in an opening provided in said operating lever, said element having a block engaging notch, and a spring in said opening to bias said element toward said block.

* * * * *